US005683136A

United States Patent [19]

Baumann et al.

[11] Patent Number: 5,683,136

[45] Date of Patent: Nov. 4, 1997

[54] TABLET ASSEMBLY FOR A SEATING SYSTEM

[75] Inventors: Stephen J. Baumann; Martin E. Gunderson; Yung Tse; Greg R. Finses, all of Green Bay, Wis.

[73] Assignee: Krueger International, Green Bay, Wis.

[21] Appl. No.: 674,995

[22] Filed: Jul. 3, 1996

Related U.S. Application Data

[63] Continuation of Ser. No. 372,495, Jan. 13, 1995, abandoned.

[51] Int. Cl.[6] ..... A47B 39/02

[52] U.S. Cl. ..... 297/162; 297/160

[58] Field of Search ..... 297/160, 161, 297/162, 155

[56] References Cited

U.S. PATENT DOCUMENTS

| | | | |
|---|---|---|---|
| 2,673,597 | 3/1954 | Hitchcock | 297/160 |
| 3,292,972 | 12/1966 | Krueger | 297/162 X |
| 3,351,377 | 11/1967 | Anderson | 297/162 X |
| 3,353,866 | 11/1967 | Chapman et al. | 297/162 |
| 3,367,713 | 2/1968 | Krueger | 297/162 |
| 3,467,432 | 9/1969 | Sullivan | 297/162 |
| 3,479,084 | 11/1969 | Ryn | 297/162 X |
| 3,556,588 | 1/1971 | Monyer et al. | 297/155 X |
| 3,575,466 | 4/1971 | Monroe et al. | 297/155 X |
| 4,428,616 | 1/1984 | Hamilton | 297/145 |
| 4,685,726 | 8/1987 | Wolpert, Jr. | 297/150 |
| 4,848,833 | 7/1989 | Grall | 297/162 |

*Primary Examiner*—Peter M. Cuomo
*Assistant Examiner*—Stephen Vu
*Attorney, Agent, or Firm*—Andrus, Sceales, Starke & Sawall

[57] ABSTRACT

A mounting assembly to mount a tablet to the support of a seating assembly includes a slide rod mounted to the underside of the tablet, a pivot shaft mounted to and extending forwardly from a support, and a slide member pivotably mounted to the pivot shaft and slidably mounted to the slide rod. The slide member includes a pivot shaft mounting portion defining a passage within which the pivot shaft is received, and a slide rod mounting portion within which the slide rod is slidably received. The slide rod and pivot shaft mounting portions define passages within which the slide rod and pivot shaft, respectively, are received, with the passages being oriented at an angle to each other. A stop arrangement is interposed between the pivot shaft and the pivot shaft mounting portion of the slide member for controlling the range of pivoting movement of the slide member, and thereby the tablet, relative to the pivot shaft. A retainer arrangement is mounted to the slide member between the slide rod and an eccentric actuator associated with the pivot shaft, for preventing relative movement between the slide member and the slide rod, and thereby the tablet, when the tablet is in a horizontal, operative position.

21 Claims, 5 Drawing Sheets

FIG. 2
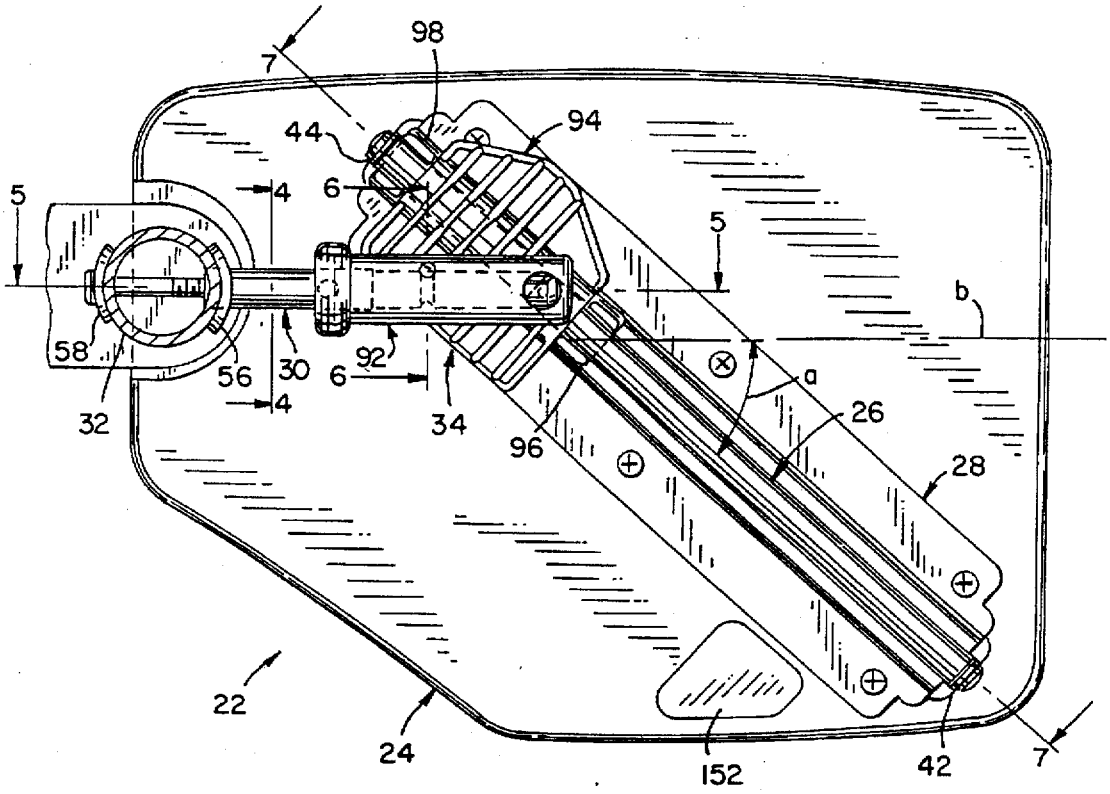
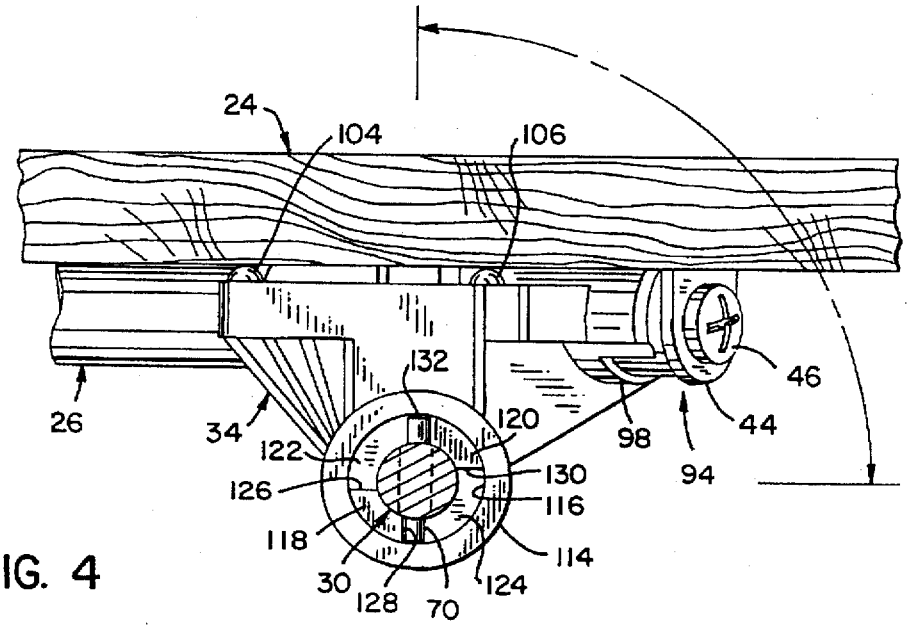
FIG. 4

FIG. 5
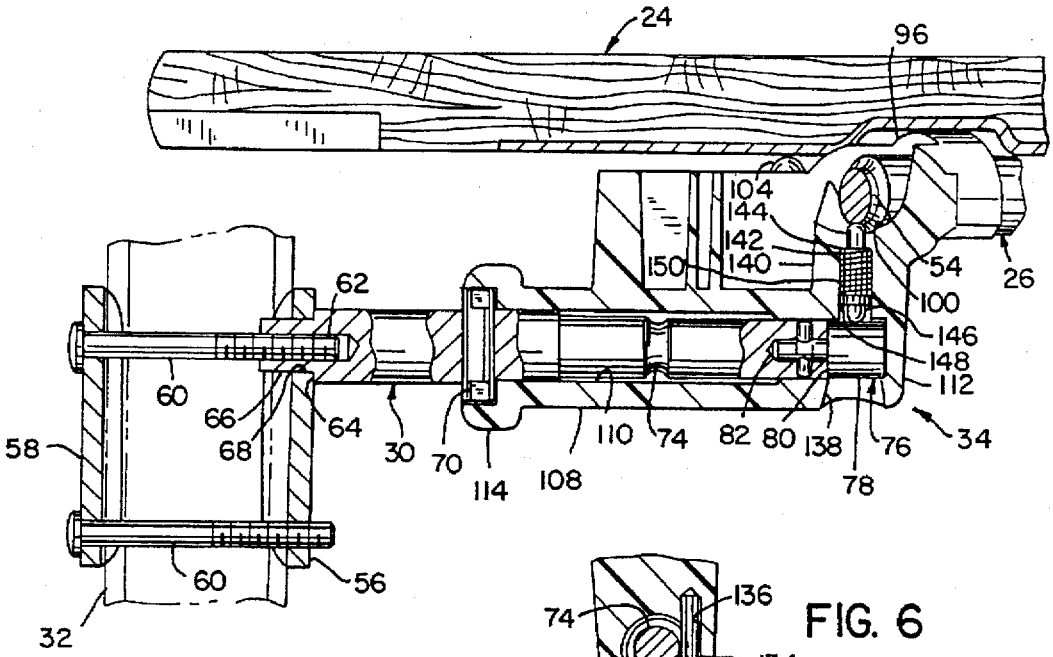
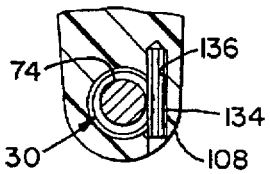
FIG. 6
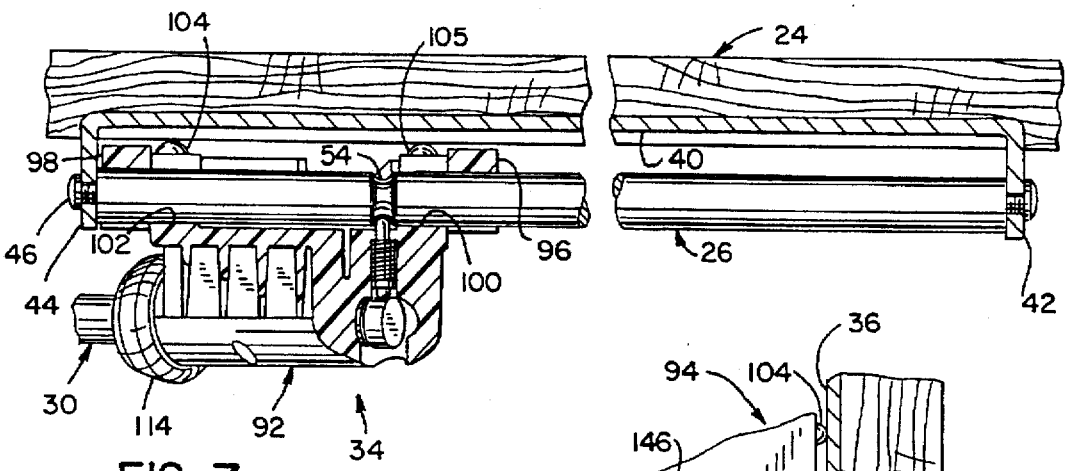
FIG. 7
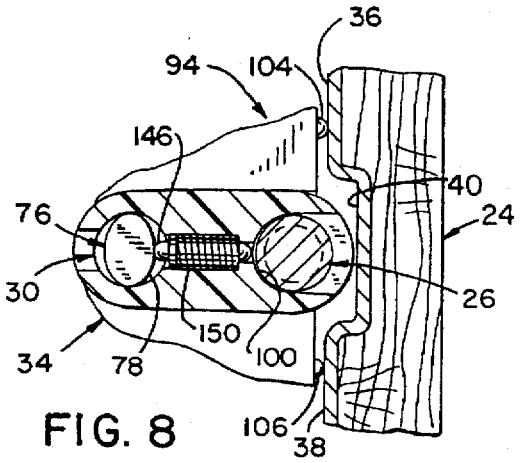
FIG. 8

FIG. 9
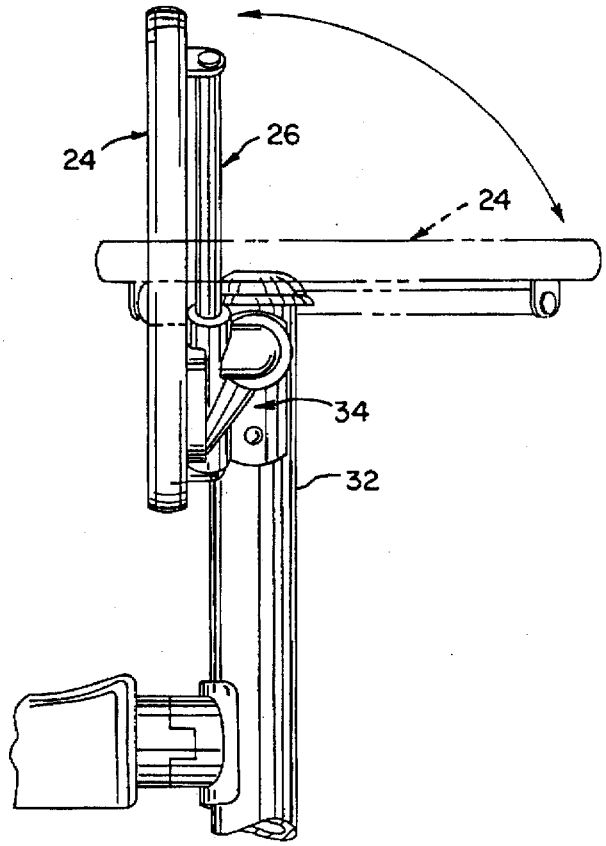
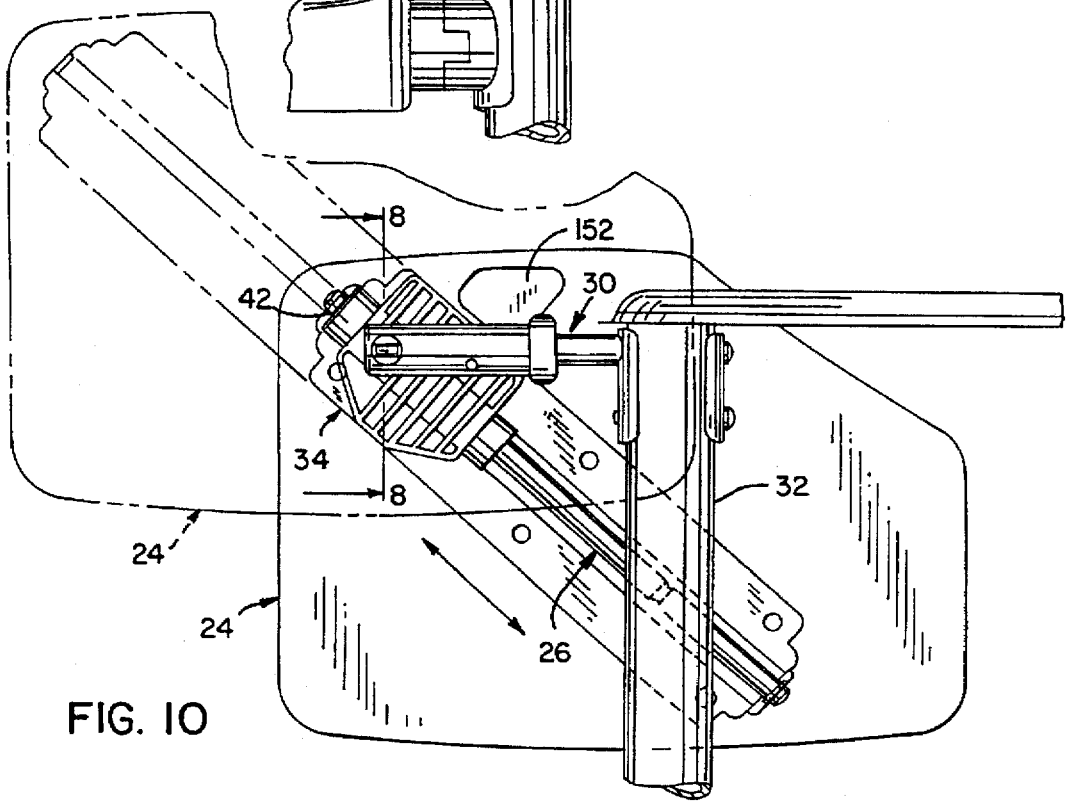
FIG. 10

TABLET ASSEMBLY FOR A SEATING SYSTEM

CROSS REFERENCE TO RELATED APPLICATION

This application is a file wrapper continuation of application Ser. No. 08/372,495, filed Jan. 13, 1995, now abandoned.

BACKGROUND AND SUMMARY OF THE INVENTION

This invention relates to a tablet arm assembly for use in combination with a chair or seat, in which the tablet arm assembly is movable between a stored position and an operative position.

In fixed seating systems, it is common to mount a tablet arm to the side support of the seating assembly, such as in an auditorium or educational environment so as to enable a seated person to take notes or the like. A tablet arm assembly typically includes a planar board or tablet defining an upper writing surface, which is mounted to a movable mounting arrangement providing movement of the tablet between an operative position in which the tablet upper surface is substantially horizontal, and a storage position in which the tablet is moved either under the seat or downwardly and beside the side support of the seat.

It is an object of the present invention to provide an improved tablet mounting mechanism for a tablet arm assembly for use with a seat or chair. It is a further object of the invention to provide such a tablet mounting mechanism which is relatively simple in its construction and which provides ease of assembly and mounting to the seat support. It is a further object of the invention to provide such a tablet mounting mechanism which provides quick and easy movement of the tablet between its operative and storage positions, without having to move the tablet in an arcuate path between its storage and operative positions. Yet another object of the invention is to provide a simple, easily operated tablet mounting mechanism which can be easily retrofit onto an existing seat support.

In accordance with the invention, a tablet assembly includes a tablet and a tablet mounting assembly or mechanism interposed between the tablet and the seat support. The mounting assembly includes a pivot shaft mounted to and extending from the support; a slide member pivotably mounted to the shaft; and a slide rod mounted to the tablet. The slide member is slidably mounted to the slide rod. The slide member and the pivot shaft are constructed and arranged so as to provide pivoting movement of the tablet between an operative position in which an upper surface defined by the tablet is disposed substantially horizontally; a raised intermediate position in which the tablet is disposed such that its upper surface is non-horizontal and the slide rod is oriented in a downwardly inclined forward-to-rearward orientation, and a storage position in which the tablet and the slide rod are slid downwardly and rearwardly on the slide member along the longitudinal axis of the slide rod. The pivot shaft extends forwardly from the support. The slide member includes a rearwardly opening pivot shaft passage within which the pivot shaft is received, and a slide rod passage oriented at an angle to the pivot shaft passage within which the slide rod is slidably received. A stop arrangement is interposed between the slide member and the pivot shaft for controlling the range of pivoting movement of the slide member on the pivot shaft, and thereby the range of pivoting movement of the tablet between its operative and intermediate positions. The stop arrangement is preferably in the form of a pin fixed to the pivot shaft and extending outwardly therefrom, and engagement structure provided on the slide member and engageable with the pin upon pivoting movement of the slide member. A retainer arrangement is interposed between the pivot shaft and the slide rod for preventing relative movement between the slide member and the rod when the tablet is in its operative position. The retainer arrangement includes a retainer member, such as a pin, movably mounted to the slide member for movement between a retaining position and a release position. In its retaining position, the pin is engaged with the slide rod, such as within a groove formed within the slide rod, for preventing movement between the slide rod and the slide member. In its release position, the pin is moved out of engagement with the slide rod. The pin is movable between its retaining position and its release position in response to movement of the tablet, and thereby the slide member, from its operative position to its intermediate position. The pin is preferably urged via a spring into engagement with cam structure associated with the pivot shaft, and movement of the tablet and slide member to the tablet operative position results in a follower end of the pin riding on the cam structure to force the opposite end of the pin into engagement with the slide rod groove against the force of the spring. Movement of the tablet and the slide member to the tablet intermediate position results in the pin follower end riding on the cam structure and movement of the opposite pin end out of engagement with the slide rod under the influence of the spring. The pivot shaft preferably includes a circumferential groove, and a roll pin is engaged with the slide member and received within the groove for preventing longitudinal movement of the slide member on the pivot shaft.

The invention further contemplates a method of mounting a tablet to a seating assembly, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 2 is a bottom plan view of the tablet assembly of FIG. 1, reference being made to line 2—2 of FIG. 1;

FIG. 4 is a partial section view taken along line 4—4 of FIG. 2;

FIG. 5 is a partial section view taken along line 5—5 of FIG. 2, showing the tablet in its operative position;

FIG. 6 is a partial section view taken along line 6—6 of FIG. 2;

FIG. 7 is a section view taken along line 7—7 of FIG. 2, showing the tablet in its operative position;

FIG. 8 is an enlarged partial section view showing the tablet in its raised intermediate position;

FIG. 9 is a front elevation view of the tablet arm assembly of FIGS. 1 and 2, showing movement of the tablet between its operative position and its raised intermediate position; and FIG. 10 is a side elevation view of the tablet arm assembly of FIGS. 1 and 2, showing movement of the tablet between its raised intermediate position and its storage position.

DETAILED DESCRIPTION OF THE INVENTION

Figure 1:
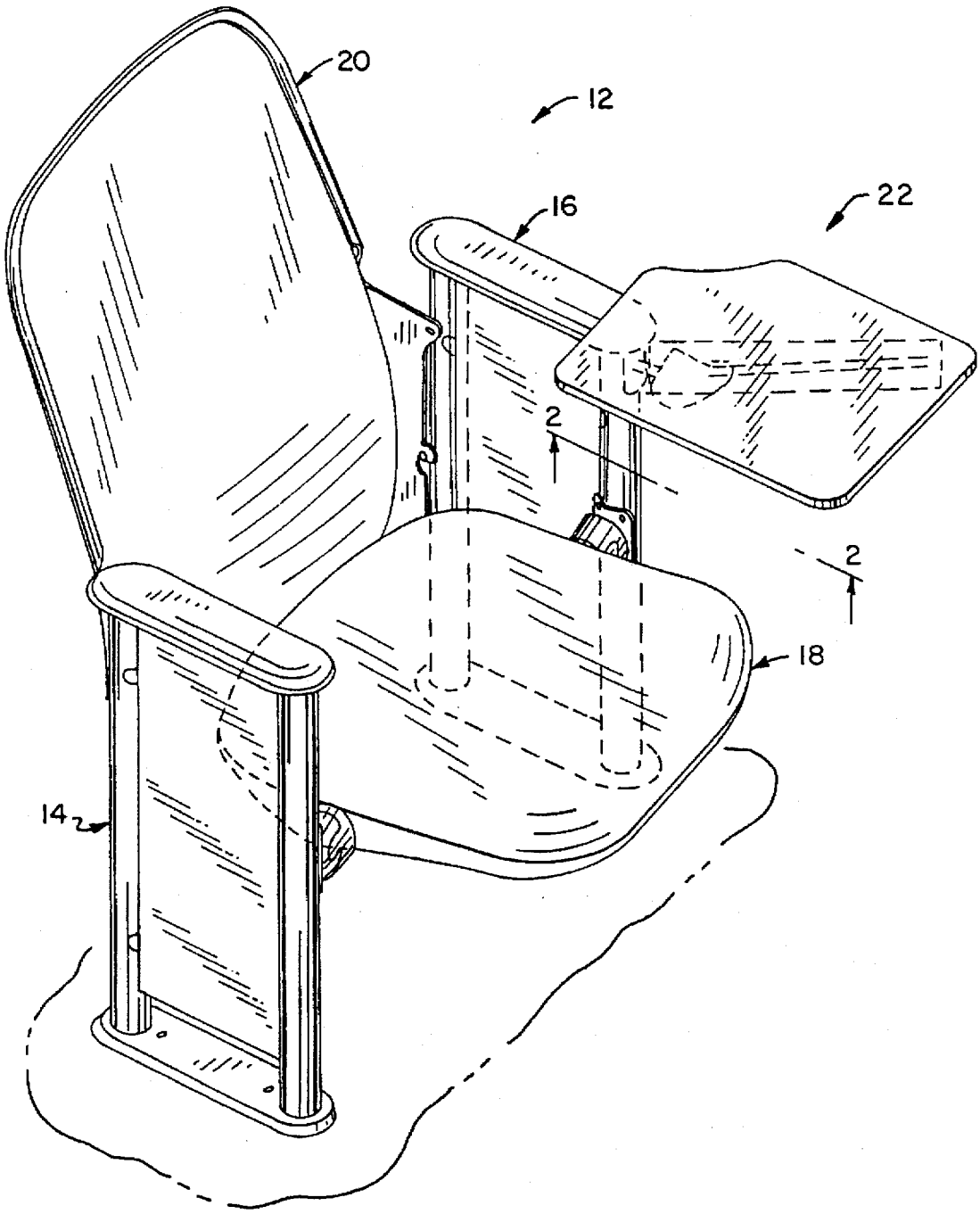
FIG. 1 is an isometric view of a seating assembly to which a tablet assembly constructed according to the invention is mounted.

Referring to FIG. 1, a seating assembly 12 generally includes a pair of side support assemblies 14, 16 mounted to the floor or other supporting surface, a seat assembly 18 and a back assembly 20, both of which are mounted between side support assemblies 14, 16. In a manner as is known, seat assembly 18 includes a rear portion located adjacent back assembly 20, and a front portion. The details of construction and operation of side support assemblies 14, 16, seat assembly 18 and back assembly 20 are set forth in greater detail in co-pending patent application Ser. No. 08/372,229, filed Jan. 13, 1995 (on even date herewith).

A tablet arm assembly, shown generally at 22 and constructed according to the present invention, is mounted to side support assembly 16.

As set forth in the above-referenced co-pending patent application, side support assembly 16 is a common support for adjacent sides of seat 18, back 20, and similarly constructed seat and back assemblies (not shown) which form a part of an adjacent seating assembly substantially similar to seating assembly 12. Tablet arm assembly 22, as illustrated in FIG. 1, is adapted for use by a right-handed person sitting in the seating assembly (not shown) located adjacent seating assembly 12 to the left of a person seated within seating assembly 12. A similarly constructed left-handed version of tablet arm assembly 22 is also contemplated.

Figure 3:
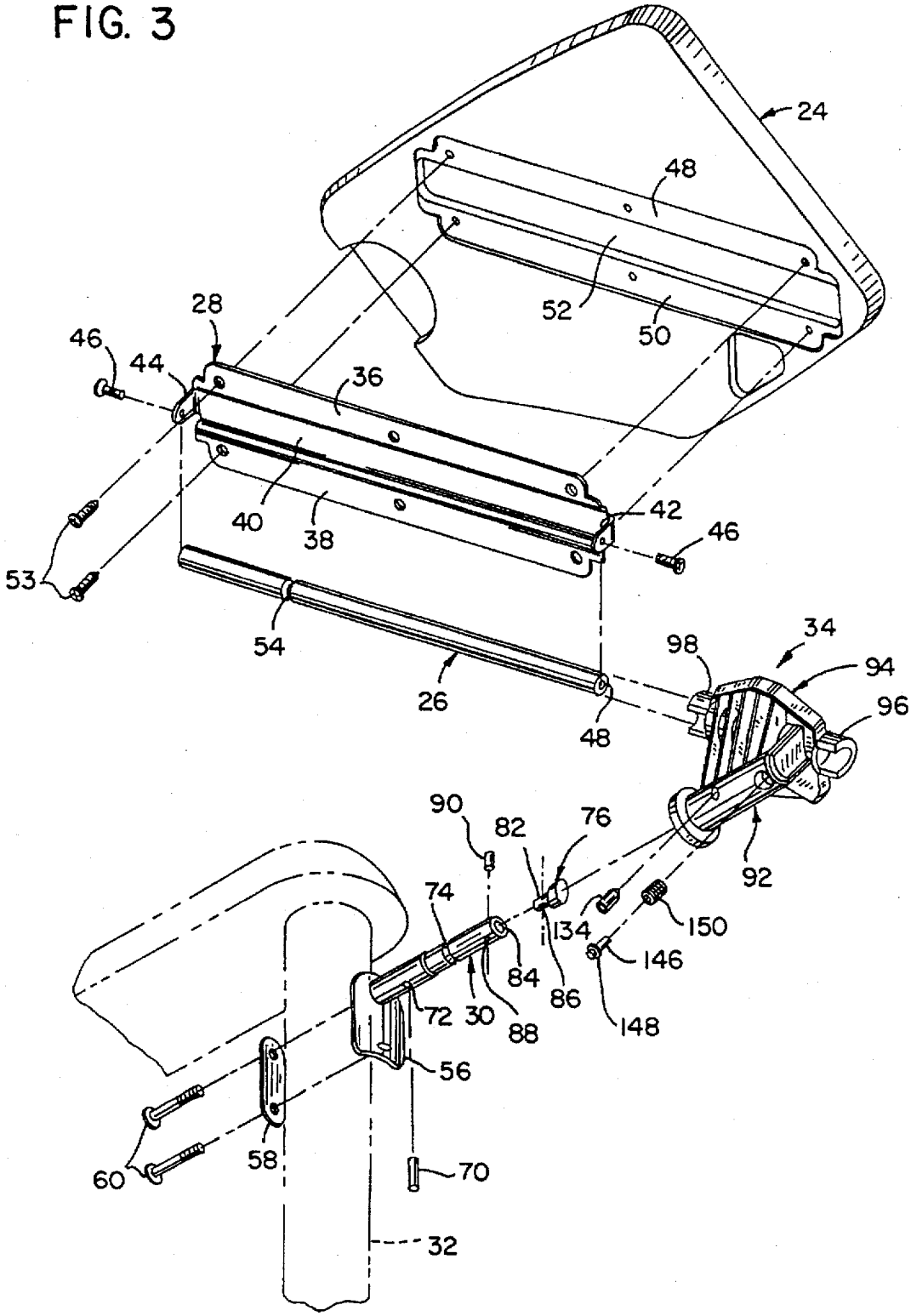
FIG. 3 is an exploded bottom perspective view of the tablet assembly of FIG. 2.

Referring to FIGS. 2 and 3, tablet arm assembly 22 generally includes a tablet 24, a slide rod 26 mounted to tablet 24 via a bracket 28, a pivot shaft 30 mounted to and extending forwardly from a vertical support tube 32 forming a part of side support assembly 16, and a slide member 34 interconnected with slide rod 26 and pivot shaft 30, in a manner to be explained.

Bracket 28 includes mounting flanges 36, 38 and a recessed central portion 40, with a pair of mounting tabs 42, 44 located at the ends of central portion 40. Slide rod 26 is mounted to tabs 42, 44 via engagement of screws 46 within threaded passages, such as 48, formed in the ends of slide rod 26.

Bracket 28 is mounted to the underside of tablet 24 within a recess formed therein which defines side portions 48, 50 adapted to receive flanges 36, 38, respectively, and a central portion 52 adapted to receive bracket central portion 40. Screws 53 extend through openings formed in flanges 36, 38 and into tablet 24 to secure bracket 28 and rod 26 to tablet 24. With this arrangement, slide rod 26 is securely stationarily fixed to tablet 24, and extends along a longitudinal axis as defined by the recess formed in the underside of tablet 24 at an angle a (FIG. 2) of approximately 45° relative to the longitudinal axis b of tablet 24, which is substantially parallel to the longitudinal axis of pivot shaft 30.

Slide rod 26 includes a circumferential groove 54.

Referring to FIGS. 2, 3 and 5, pivot shaft 30 is mounted at its rearward end, such as by welding, to a mounting flange 56 having a curvature corresponding to that of support tube 32. A mounting plate 58, also having a curvature corresponding to that of support tube 32, is engaged with support tube 32 opposite flange 56, and threaded screws 60 extend between and interconnect flange 56 and plate 58 through aligned openings formed in the walls of support tube 32, to mount pivot shaft 30 to support tube 32. As shown in FIG. 5, pivot shaft 30 includes a threaded passage 62 within which the threads of the upper one of screws 60 are engaged. Pivot shaft 30 further defines a shoulder 64 toward its rearward end, from which a reduced diameter portion 66 extends. Reduced diameter portion 66 has an irregular cross-section, and extends through a correspondingly shaped opening 68 formed in flange 56, such that shoulder 64 bears against flange 56 adjacent opening 68. The lower one of screws 60 functions to clamp flange 56 and plate 58 together onto support tube 32, while the upper one of screws 60 provides the same function while also securely mounting pivot shaft 30 to support tube 32, such that pivot shaft 30 extends perpendicularly and forwardly relative to support tube 32.

A stop pin 70 is press-fit into a transverse passage 72 formed in pivot shaft 30 such that opposite ends of stop pin 70 extend outwardly from opposite sides of pivot shaft 30. A circumferential groove 74 is formed about pivot shaft 30 forwardly of stop pin 70, the purpose of which will later be explained. An actuator cam 76, the purpose of which will also later be explained, is mounted at the forward end of pivot shaft 30. Actuator cam 76 includes an elliptical cam surface 78, and defines a rearwardly facing shoulder 80 abutting the forward end of pivot shaft 30. Cam 76 further includes a stem 82 extending rearwardly from shoulder 80, which is received within a passage 84 extending rearwardly from the forward end of pivot shaft 30. Stem 82 includes a transverse passage 86 which is in alignment with a transverse passage 88 formed in pivot shaft 30 when actuator cam shoulder 80 is engaged with the forward end of pivot shaft 30. A mounting pin 90 extends through pivot shaft passage 88 and actuator cam passage 82 to mount actuator cam 76 to the forward end of pivot shaft 30 in a manner such that actuator cam 76 is fixed against rotation.

Referring to FIGS. 2, 3 and 4, slide member 34 generally consists of a pivot shaft mounting section 92 and a slide rod mounting section 94, integrally formed together into a one-piece member, such as by injection molding or the like. Slide member 34 may be formed of any satisfactory material, such as nylon or other highly durable metal or non-metal material.

Slide rod mounting section 94 includes a pair of collars 96, 98 formed at opposite ends thereof, each of which defines a passage within which slide rod 26 is received, and a pair of trough-shaped surfaces 100, 102 which cooperate with collars 96, 98 to slidably mount slide rod 26 to slide rod mounting section 94 in an offset manner. Collars 96, 98 and troughs 100, 102 are dimensioned and arranged so as to provide close tolerancing with slide rod 26, and together cooperate to define a circular passageway at spaced locations along the length of slide rod 26 for slidably mounting slide rod 26 to slide rod mounting section 94.

As shown in FIGS. 4, 7 and 8, slide rod mounting section 94 further includes a series of protrusions 104, 105, 106 located such that protrusions 104, 105 are located on one side of slide rod 26 and on the other side of slide rod 26. Protrusions 104–106 engage bracket mounting flanges 36, 38, when slide rod mounting portion 94 is engaged with slide rod 26, so as to prevent tablet 24 from rocking on slide rod 26. In this manner, when tablet 24 is pivoted about slide rod 26, such pivoting movement is transferred through protrusions 104–106 to slide member 34.

As shown in FIG. 5, pivot shaft mounting section 92 of slide member 34 generally defines a rearwardly opening cylindrical shape having an annular side wall 108 defining a longitudinally extending internal passage 110, an end wall 112, and an enlarged annular rear end portion 114 located at the rearward end of side wall 108.

Referring to FIG. 4, enlarged rear end portion 114 defines a rearwardly-facing recess 116 within which the ends of stop pin 70, which extend outwardly from pivot shaft 30, are received. A pair of opposed stop bosses 118, 120 are located within recess 116, extending rearwardly from shoulder surfaces 122, 124 defining the forward end of recess 116. Stop boss 118 defines a horizontal stop surface 126 and a vertical stop surface 128, and stop boss 120 defines a horizontal stop surface 130 and a vertical stop surface 132. With this arrangement, the end portions of pin 70 engage vertical stop surfaces 128, 132 to position tablet 24 in a horizontal, operative position as shown in FIG. 4, and engage horizontal stop surfaces 126, 130 to position tablet 24 in an intermediate raised position, as shown in FIGS. 8 and 9.

As shown in FIG. 6, a roll pin 134 is received within a passage 136 formed in side wall 108. Passage 136 is arranged so as to be in alignment with pivot shaft groove 74, such that roll pin 134 extends into groove 74 when received within passage 136. Roll pin 134 thus prevents relative longitudinal movement between slide member 34 (FIG. 5) and pivot shaft 30, while accommodating pivoting movement of slide member 34 on pivot shaft 30.

As shown in FIG. 5 and as previously discussed, actuator cam 76 is mounted to the end of pivot shaft 30. Actuator cam 76 is disposed within the forward end of passage 110 adjacent end wall 112. An opening 138 is formed in side wall 108 adjacent end wall 112.

As shown in FIGS. 5, 7, and 8, slide member 34 includes a connector section, shown at 140, which extends upwardly at the forward end of pivot shaft mounting section 92 to interconnect slide rod mounting section 94 with pivot shaft mounting section 92. A vertical passage 142 is formed in connector section 140, extending between pivot shaft mounting section passage 110 and opening into trough 100 adjacent slide rod 26. Passage 142 defines a downwardly facing shoulder 144.

A retainer pin 146 is received within passage 142. A collar 148 is fixed to retainer pin 146, and a spring 150 bears between passage shoulder 144 and collar 148, for biasing a follower end of pin 146 into engagement with cam member 76. The upper, retaining end of pin 146 extends into the portion of passage 142 above shoulder 144 adjacent trough 100 and groove 54 formed in slide rod 26.

In operation, tablet arm assembly 22 functions as follows. Initially, tablet 24 is in its storage position as shown in solid lines in FIG. 10. In this position, slide member 34 is at the upper, forward end of slide rod 26, and is engaged with tab 42 to retain tablet 24 in its lowered, storage position. To move tablet 24 to its operative position as shown in FIGS. 1 and 2, tablet 24 is grasped by the user such as at recess 152 (FIG. 10) formed in the underside of tablet 24, and is moved upwardly and forwardly to its phantom line position of FIG. 10, in which tablet 24 is in a raised intermediate position. In this position, slide member 34 is positioned at the lower, rearward end of slide rod 26 in engagement with tab 44 of bracket 28. While still grasping tablet 24, the user pivots tablet 24 from its raised intermediate position as shown in solid lines in FIG. 9 to its horizontal operative position, as shown in phantom in FIG. 9 and as shown in solid lines in FIGS. 1, 2, 4, 5 and 7. Movement of tablet 24 from its raised intermediate position to its operative position causes pivoting movement of slide member 34 about pivot shaft 30. As noted previously, the range of pivoting movement of tablet 24 is controlled by engagement of the ends of stop pin 70 with stop surfaces 126–132 provided on the rearward end of pivot shaft mounting section 92 of slide member 34. As also noted previously, such pivoting movement of slide member 34 relative to pivot shaft 30 is accommodated by movement of roll pin 134 within pivot shaft groove 72.

With slide member 34 in its rearwardmost position on slide rod 26, and with pivoting movement of slide member 34 from a vertical position (when tablet 24 is oriented vertically in its raised intermediate position) and a horizontal position (when tablet 24 is in its operative position), retainer pin 146 moves between its release position, as shown in FIG. 8, and its retaining position as shown in FIGS. 5 and 7. When tablet 24 is in its raised intermediate position as shown in FIG. 8, spring 150 functions to move the retaining end of pin 146 out of slide rod groove 54, by maintaining the follower end of pin 146 with actuator cam 76. As shown in FIG. 8, actuator cam surface 78 is shaped elliptically and is mounted to the forward end of pivot shaft 30 such that its major axis is oriented vertically and its minor axis is oriented horizontally. With this construction, and with spring 150 maintaining the follower end of pin 146 in engagement with cam surface 78, the retaining end of pin 146 is moved out of groove 54 when tablet 24 is positioned vertically, such as in its raised intermediate position and in its storage position. This enables free sliding movement between slide member 34 and slide rod 26, and thereby movement of tablet 24 between its storage and raised intermediate positions. Upon pivoting movement of tablet 24 to its horizontal, operative position and thereby movement of slide member 34 to a horizontally oriented position, the follower end of pin 146 rides on cam surface 78 so as to engage the uppermost point of cam surface 78, as shown in FIG. 7. This forces the retaining end of pin 146 into slide rod groove 54, to thereby prevent relative movement between slide member 34 and slide rod 26 when tablet 24 is in its horizontal, operative position.

To return tablet 24 to its storage position after use, the operator reverses the above steps by first pivoting tablet arm 24 about pivot shaft 30 to its raised intermediate position, which movement is controlled by engagement of stop pin 70 with horizontal stop surfaces 126, 130. This returns retaining pin 146 to its release position of FIG. 8 by spring 150 maintaining engagement of the follower end of pin 146 with cam surface 78, out of engagement with slide rod groove 54. This allows sliding movement of slide member 34, and thereby tablet 24, on slide rod 26. Tablet 24 then falls by gravity to its storage position as shown in solid lines in FIG. 10 by moving slide rod 26 downwardly and rearwardly, along its longitudinal axis, on slide member 34.

As can be appreciated, the orientation of slide rod 26, in which slide rod 26 is at an angle to the longitudinal front-rear axis of tablet 24, enables tablet 24 to be moved both forwardly and upwardly when tablet 24 is moved from its storage position to its raised, intermediate position. This also enables pivoting movement of slide member 34 on pivot rod 30 when tablet 24 is moved from its raised, intermediate position to its operative position.

As can also be appreciated, the mounting assembly of the present invention provides an assembly which is quick and easy to mount to the seat support, either during original manufacture or as a retrofit.

Various alternatives and embodiments are contemplated as being within the scope of the following claims particularly pointing out and distinctly claiming the subject matter regarded as the invention.

We claim:

1. A tablet assembly for use with a seating arrangement including a seat having a front and a rear and a support located adjacent a side of the seat, comprising:

a tablet having a longitudinal front-rear axis;

a tablet mounting assembly interposed between the tablet and the support, including a pivot shaft mounted to and extending from the support; a slide member pivotably mounted to the shaft; and a slide rod having a forward end and a rearward end, wherein the slide rod is mounted to the tablet at an angle relative to the longitudinal front-rear axis of the tablet, wherein the slide member is slidably mounted to the slide rod;

wherein the slide member and the pivot shaft are constructed and arranged so as to provide pivoting movement of the tablet between an operative position in which an upper surface defined by the tablet is substantially horizontal; an intermediate position in which the tablet is disposed such that said upper surface is non-horizontal and the slide rod is oriented in a downwardly inclined forward-to-rearward orientation and the slide member is positioned toward the rearward end of the slide rod, and a storage position in which the slide member is positioned at the forward end of the slide rod and the slide rod and the tablet are slid downwardly and rearwardly on the slide member along the longitudinal axis of the slide rod; and a stop arrangement interposed between the slide member and the pivot shaft for controlling the range of pivoting movement of the slide member on the pivot shaft, and thereby the range of pivoting movement of the tablet between said operative and intermediate positions, wherein the stop arrangement comprises a pin fixed to the pivot shaft and extending outwardly therefrom, and engagement structure engageable with the pin upon pivoting movement of the slide member, the engagement structure defining at least first and second stop surfaces engageable with the pin when the tablet is in said operative and intermediate positions, respectively.

2. A tablet assembly for use with a seating arrangement including a seat having a front and a rear and a support located adjacent a side of the seat, comprising:

a tablet having a longitudinal front-rear axis;

a tablet mounting assembly interposed between the tablet and the support, including a pivot shaft mounted to and extending from the support; a slide member pivotably mounted to the pivot shaft; and a slide rod having a forward end and a rearward end, wherein slide rod is mounted to the tablet at an angle relative to the longitudinal front-rear axis of the tablet, wherein the slide member is slidably mounted to the slide rod;

wherein the slide member and the pivot shaft are constructed and arranged so as to provide pivoting movement of the tablet between an operative position in which an upper surface defined by the tablet is substantially horizontal; an intermediate position in which the tablet is disposed such that said upper surface is non-horizontal and the slide rod is oriented in a downwardly inclined forward-to-rearward orientation and the slide member is positioned toward the rearward end of the slide rod, and a storage position in which the slide member is positioned at the forward end of the slide rod and the slide rod and the tablet are slid downwardly and rearwardly on the slide member along the longitudinal axis of the slide rod; and a retainer arrangement interposed between the pivot shaft and the slide rod for preventing movement of the slide member on the slide rod when the tablet is in said operative position.

3. The tablet assembly of claim 2, further comprising a stop arrangement interposed between the slide member and the pivot shaft for controlling the range of pivoting movement of the slide member on the pivot shaft, and thereby the range of pivoting movement of the tablet between said operative and intermediate positions.

4. The tablet assembly of claim 2, wherein the slide member includes a pivot shaft passage within which the pivot shaft is received, and a slide rod passage oriented at an angle to the pivot shaft passage within which the slide rod is slidably mounted.

5. The tablet assembly of claim 4, wherein the retainer arrangement includes a retainer member movably mounted to the slide member for movement between a retaining position in which the retainer member is engaged with the slide rod for preventing relative movement between the slide rod and the slide member, and a release position in which the retainer member is moved out of engagement with the slide rod.

6. The tablet assembly of claim 5, wherein the retainer member is movable between said retaining position and said release position in response to movement of the tablet, and thereby the slide member, from said operative position to said intermediate position.

7. The tablet assembly of claim 6, wherein the retainer member comprises a pin mounted to the slide member and interposed between the slide rod and the pivot shaft, the pin defining first and second ends.

8. The tablet assembly of claim 7, further comprising bias means for urging the first end of the pin away from the slide rod, and cam structure associated with the pivot shaft and engageable by the second end of the pin, wherein movement of the tablet and slide member to the operative position results in movement of the first end of the pin into engagement with the slide rod against the force of the bias means, and wherein movement of the tablet and slide member to the intermediate position results in the pin second end riding on the cam structure and movement of the pin first end out of engagement with the slide rod under the influence of the bias means.

9. The tablet assembly of claim 7, wherein the slide rod includes a groove within which the pin first end is received when the pin is in said retaining position.

10. A tablet assembly for use with a seating arrangement including a seat having a front and a rear and a support located adjacent a side of the seat, comprising:

a tablet having a longitudinal front-rear axis;

a tablet mounting assembly interposed between the tablet and the support, including a pivot shaft mounted to and extending from the support; a slide member pivotably mounted to the pivot shaft; and a slide rod having a forward end and a rearward end, wherein the slide rod is mounted to the tablet at an angle relative to the longitudinal front-rear axis of the tablet, wherein the slide member is slidably mounted to the slide rod;

wherein the slide member and the pivot shaft are constructed and arranged so as to provide pivoting movement of the tablet between an operative position in which an upper surface defined by the tablet is substantially horizontal; an intermediate position in which the tablet is disposed such that said upper surface is non-horizontal and the slide rod is oriented in a downwardly inclined forward-to-rearward orientation and the slide member is positioned toward the rearward end of the slide rod, and a storage position in which the slide member is positioned at the forward end of the slide rod and the slide rod and the tablet are slid downwardly and rearwardly on the slide member along the longitudinal axis of the slide rod;

wherein the pivot shaft includes a circumferential groove, and further comprising a roll pin engaged with the slide member and received within the groove for preventing longitudinal movement of the slide member on the pivot shaft.

11. A tablet assembly for use with a seating arrangement including a seat having a front and a rear, and a support, comprising:

a tablet having a longitudinal front-rear axis;

a mounting arrangement for providing pivoting movement of the tablet between an operative position in which an upper surface of the tablet is disposed substantially horizontally and a storage position in which the tablet is positioned substantially vertically, the mounting arrangement including a slide rod mounted to the tablet at an angle relative to the longitudinal front-rear axis and being movable within a slide member adapted to be mounted to the support, wherein the slide member is adapted to be pivotably mounted to the support via a pivot shaft secured to the support to which the slide member is adapted to be pivotably mounted, wherein the pivot shaft is adapted to extend forwardly from the support; and wherein the slide member includes a first passage within which the pivot shaft is received and a second passage, disposed at an angle to the first passage, within which the slide rod is received.

12. The tablet assembly of claim 11, wherein the slide member and the slide rod are constructed and arranged such that the slide rod is movable within the second passage between a first storage position in which the tablet is moved downwardly and rearwardly adjacent the support, and an intermediate raised position in which the tablet is moved upwardly and forwardly.

13. The tablet assembly of claim 12, wherein the tablet is movable to an operative position from said raised intermediate position by pivoting the tablet and the slide member downwardly about the pivot shaft.

14. A tablet assembly for use with a seating arrangement including a seat and a support located adjacent a side of the seat, comprising:

a tablet;

a tablet mounting assembly interposed between the tablet and the support, including a pivot shaft adapted to be mounted to and extending from the support; a slide member pivotably mounted to the shaft; and a slide rod mounted to the tablet, wherein the slide member is slidably mounted to the slide rod;

wherein the slide member and the pivot shaft are constructed and arranged so as to provide pivoting movement of the tablet between an operative position in which an upper surface defined by the tablet is substantially horizontal; an intermediate position in which the tablet is disposed such that said upper surface is non-horizontal and the slide rod is oriented in a downwardly inclined forward-to-rearward orientation, and a storage position in which the slide rod and the tablet are slid downwardly and rearwardly on the slide member along the longitudinal axis of the slide rod; and a retainer arrangement interposed between the pivot shaft and the slide rod for preventing movement of the slide member on the slide rod when the tablet is in said operative position.

15. The tablet assembly of claim 14, wherein the slide member includes a pivot shaft passage within which the pivot shaft is received, and a slide rod passage oriented at an angle to the pivot shaft passage within which the slide rod is slidably mounted.

16. The tablet assembly of claim 15, wherein the retainer arrangement includes a retainer member movably mounted to the slide member for movement between a retaining position in which the retainer member is engaged with the slide rod for preventing relative movement between the slide rod and the slide member, and a release position in which the retainer member is moved out of engagement with the slide rod.

17. The tablet assembly of claim 16, wherein the retainer member is movable between said retaining position and said release position in response to movement of the tablet, and thereby the slide member, from said operative position to said intermediate position.

18. The tablet assembly of claim 17, wherein the retainer member comprises a pin mounted to the slide member and interposed between the slide rod and the pivot shaft, the pin defining first and second ends.

19. The tablet assembly of claim 18, further comprising bias means for urging the first end of the pin away from the slide rod, and cam structure associated with the pivot shaft and engageable by the second end of the pin, wherein movement of the tablet and slide member to the operative position results in movement of the first end of the pin into engagement with the slide rod against the force of the bias means, and wherein movement of the tablet and slide member to the intermediate position results in the pin second end riding on the cam structure and movement of the pin first end out of engagement with the slide rod under the influence of the bias means.

20. The tablet assembly of claim 18, wherein the slide rod, includes a groove within which the pin first end is received when the pin is in said retaining position.

21. A tablet assembly for use with a seating arrangement including a seat and a support located adjacent a side of the seat, comprising:

a tablet; and a tablet mounting assembly interposed between the tablet and the support, including a pivot shaft adapted to be mounted to and extending from the support, the pivot shaft including a circumferential groove; a slide member pivotably mounted to the pivot shaft; a slide rod mounted to the tablet, wherein the slide member is slidably mounted to the slide rod; and a roll pin engaged with the slide member and received within the groove for preventing longitudinal movement of the slide member;

wherein the slide member and the pivot shaft are constructed and arranged so as to provide pivoting movement of the tablet between an operative position in which an upper surface defined by the tablet is substantially horizontal; an intermediate position in which the tablet is disposed such that said upper surface is non-horizontal and the slide rod is oriented in a downwardly inclined forward-to-rearward orientation, and a storage position in which the slide rod and the tablet are slid downwardly and rearwardly on the slide member along the longitudinal axis of the slide rod.

* * * * *

UNITED STATES PATENT AND TRADEMARK OFFICE

CERTIFICATE OF CORRECTION

PATENT NO. : 5,683,136

DATED : November 4, 1997

INVENTOR(S) : STEPHEN J. BAUMANN ET AL

It is certified that error appears in the above-indentified patent and that said Letters Patent is hereby corrected as shown below:

In The Claims

Claim 1, column 7, line 9, before "shaft" insert -- pivot --; Claim 2, column 7, line 48, before "slide" insert -- the --; Claim 20, column 10, line 37, after "rod" delete ",".

Signed and Sealed this

Third Day of March, 1998

*Attest:*

*Attesting Officer*

Bruce Lehman

BRUCE LEHMAN

*Commissioner of Patents and Trademarks*